US006303256B1

(12) United States Patent
Kerner et al.

(10) Patent No.: US 6,303,256 B1
(45) Date of Patent: Oct. 16, 2001

(54) TONERS AND/OR TONER MIXTURES

(75) Inventors: Dieter Kerner, Hanau; Helmut Mangold, Rodenbach; Juergen Meyer, Stockstadt, all of (DE)

(73) Assignee: Degussa AG, Duesseldorf (DE)

( * ) Notice: Subject to any disclaimer, the term of this patent is extended or adjusted under 35 U.S.C. 154(b) by 0 days.

(21) Appl. No.: 09/703,864

(22) Filed: Nov. 2, 2000

Related U.S. Application Data

(63) Continuation of application No. 09/461,752, filed on Dec. 16, 1999, now Pat. No. 6,197,469.

(30) Foreign Application Priority Data

Dec. 16, 1998 (DE) ..... 198 57 912

(51) Int. Cl.[7] ..... G03G 9/097

(52) U.S. Cl. ..... 430/108.6; 430/108.7; 430/137.21

(58) Field of Search ..... 430/106, 111, 430/108.6, 108.7, 137.21; 406/404, 287.11

(56) References Cited

U.S. PATENT DOCUMENTS

| | | | | |
|---|---|---|---|---|
| 5,064,791 | * | 11/1991 | Ohtsuka et al. | 501/147 |
| 5,296,324 | | 3/1994 | Akagi et al. | 430/106 |
| 5,424,258 | | 6/1995 | Mangold et al. | 501/128 |
| 6,022,404 | * | 2/2000 | Ettlinger et al. | 106/404 |

FOREIGN PATENT DOCUMENTS

| | | |
|---|---|---|
| 37 07 226 A1 | 9/1988 | (DE) . |
| 42 02 694 C1 | 7/1993 | (DE) . |
| 2 296 915 A | 1/1996 | (GB) . |

* cited by examiner

*Primary Examiner*—John Goodrow
(74) *Attorney, Agent, or Firm*—Oblon, Spivak, McClelland, Maier & Neustadt, P.C.

(57) ABSTRACT

A toner or a mixture of toners, comprises a pyrogenically synthesized alumina-silica mixed oxide as a component in combination with other components necessary to complete a toner formulation. The surface of the mixed alumina-silica oxide material.

12 Claims, No Drawings

TONERS AND/OR TONER MIXTURES

This application is a Continuation of application Ser. No. 09/461,752 Filed on Dec. 16, 1999, now U.S. Pat. No. 6,197,469.

BACKGROUND OF THE INVENTION

1. Field of the Invention

The present invention relates to toners and/or toner mixtures.

2. Discussion of the Background

U.S. Pat. No. 5,424,258 discloses powdered silicon-aluminum mixed oxides of amorphous structure, synthesized by flame hydrolysis. The oxide compositions contain 65 to 72.1 wt. % $Al_2O_3$ and 27.9 to 35 wt. % $SiO_2$ and have a BET surface ranging from 20 to 200 $m^2/g$.

SUMMARY OF THE INVENTION

One object of the present invention is to provide a toner and/or toner mixture which contains pyrogenically synthesized alumina-silica mixed oxide which improves the properties of the toner and/or toner mixture.

Briefly, this object and other objects of the present invention as hereinafter will become more readily apparent can be attained by a toner and/or toner mixture which contains a pyrogenically synthesized silica-alumina mixed oxide as a component in addition to other components which complete a toner formulation.

DETAILED DESCRIPTION OF THE PREFERRED EMBODIMENTS

The discovery of the present invention is that the presence of a pyrogenically synthesized silica-alumina mixed oxide as an additive to a toner imparts improved properties to the toner. The amount of the pyrogenically synthesized silica-alumina incorporated in the toner normally ranges from 0.1 to 5.0% by weight based on the weight of toner. Other toner components include a pigment such as $Fe_2O_3$, a binder such as polyester resin and a charge controlling agent in the amounts these ingredients are normally used to prepare a toner.

The pyrogenically synthesized alumina-silica mixed oxide of the invention is per se known and can be prepared as described in U.S. Pat. No. 5,424,258 which is hereby incorporated by reference into the application.

In an embodiment of the invention, the $Al_2O_3/SiO_2$ mixed oxide may have a ratio of $Al_2O_3$ to $SiO_2$ comprising 65±5 wt. %$Al_2O_3$ and 35±5 wt. % $SiO_2$.

In another embodiment of the invention, the pyrogenically synthesized $Al_2O_3/SiO_2$ mixed oxide can be surface-modified. The surface modification of the mixed alumina-silica oxide material can be achieved by the technique described in European Patent EP 0 722 922, hereby incorporated by reference. Suitable surface treatment compounds include:

(a) Organosilanes of the type $(RO)_3Si(C_nH_{2n+1})$
R=alkyl, such as e.g., methyl-, ethyl-, n-propyl-, i-propyl-, butyl—
n=1–20

(b) Organosilanes of the type $R'_x(RO)_ySi(C_nH_{2+1})$
R=alkyl, such as e.g. methyl-, ethyl-, n-propyl-, i-propyl-, butyl—
R'=alkyl such as e.g. methyl-, ethyl-, n-propyl-, i-propyl-, butyl— n=1 –20
x+y=3
x=1,2
y=1,2

(c) Organosilanes of the type $(RO)_3Si(CH_2)_m$—R'
R=alkyl, such as methyl-, ethyl-, propyl—
m=0, 1 –20
R'=methyl-, aryl (e.g., —$C_6H_5$, substituted phenyl groups)
—$C_4F_9$, —$OCF_2$—CHF—$CF_3$, —$C_6F_{13}$, —O—$CF_2$—CHF2
—NH2, —$N_3$, —SCN, —CH═$CH_2$,
—$OOC(CH_3)C$═$CH_2$
—$OCH_2$—CH(O)$CH_2$

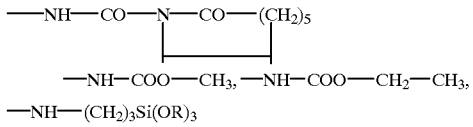

—$S_x$—$(CH_2)_3Si(OR)_3$ (d) Organosilanes of the type $(R'')_x(RO_ySi(CH_2)_m$—R'

R″ = alkyl x + y = 2
x= 1, 2
y = 1, 2
m = 0, 1 to 20

R'=methyl-, aryl (e.g. —$C_6H_5$, substituted phenyl groups)
—$C_4F_9$, —$OCF_2$—CHF—$CF_3$, —$C_6F_{13}$, —O—$CF_2$—$CHF_2$
—$NH_2$—$N_3$, —SCN, —CH═$CH_2$,
—$OOC(CH_3)C$═$CH_2$—
—$OCH_2$—CH(O)$CH_2$

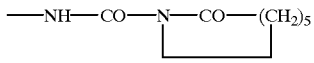

—NH—COO—$CH_3$, —NH—COO—$CH_2$—$CH_3$, —NH—$(CH_2)_3Si(OR)_3$
—$S_x$—$(CH_2)_3Si(OR)_3$ (e) Halogenorganosilanes of the type $X_3Si(C_nH_{2n+1})$
X=Cl, Br
n=1–20

(f) Halogenorganosilanes of the type $X_2(R')Si(C_nH_{2+1})$
X=Cl, Br
R'=alkyl, such as e.g. methyl-, ethyl-, n-propyl-, i-propyl-, butyl—
n=1–20

(g) Halogenorganosilanes of the type $X(R')_2Si(C_nH_{2n+1})$
X=Cl, Br
R'=alkyl, such as e.g. methyl-, ethyl-, n-propyl-, i-propyl-, butyl—
n=1–20

(h) Halogenorganosilanes of the type $X_3Si(CH_2)_m$—R'
X=Cl, Br
m=0, 1–20
R'=methyl-, aryl (e.g. —$C_6H_5$, substituted phenyl groups)
—$C_4F_9$, —$OCF_2$—CHF—$CF_3$, —$C_6F_{13}$, —O—$CF_2$—$CHF_2$
—NH2, —$N_3$, —SCN, —CH═$CH_2$,
—$OOC(CH_3)C$═$CH_2$

—$OCH_2$—CH(O)$CH_2$

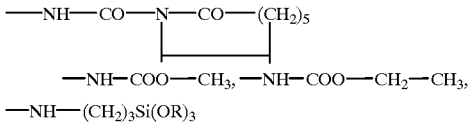

—$S_x$—$(CH_2)_3Si(OR)_3$ (i) Halogenorganosilanes of the type (R)$X_2Si(CH_2)_m$—R'
X=Cl, Br
R=alkyl, such as methyl-, ethyl-, propyl—
m=0, 1–20
R'=methyl-, aryl (e.g. —$C_6H_5$, substituted phenyl groups)
—$C_4F_9$, —$OCF_2$—CHF—$CF_3$, —$C_6F_{13}$, —O—$CF_2$—$CHF_2$
—$NH_2$, —$N_3$, —SCN, —CH═$CH_2$,
—OOC$(CH_3)$C═$CH_2$
—$OCH_2$—CH(O)$CH_2$

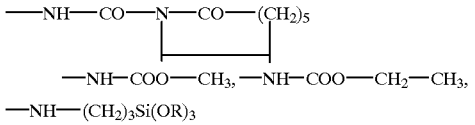

in which R can be =methyl-, ethyl-, propyl-, butyl
—$S_x$—$(CH_2)_3Si(OR)_3$ in which R can be =methyl-, ethyl-, propyl-, butyl—

(j) Halogenorganosilanes of the type $(R)_2X$ $Si(CH_2)_m$—R'
X=Cl, Br
R=alkyl
m=0, 1–20
R'=methyl-, aryl (e.g. —$C_6H_5$, substituted phenyl groups)
—$C_4F_9$, —$OCF_2$—CHF—$CF_3$, —$C_6F_{13}$, —O—$CF_2$—$CHF_2$
—$NH_2$, —$N_3$, —SCN, —CH═$CH_2$,
—OOC$(CH_3)$C═$CH_2$
—$OCH_2$—CH(O)$CH_2$

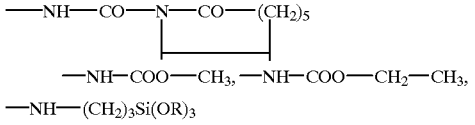

—$S_{x—(CH2)}{}_3Si(OR)_3$

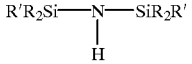

(k) Silazanes of the type

R = alkyl
R′ = alkyl, vinyl (1) A preferred silazane in hexamethyldisilazane (HMDS). Cyclic polysiloxanes of the type D 3, D 4, D 5 in which D 3, D 4 and D 5 signify cyclic polysiloxanes with 3, 4 or 5 units of the type —O—$Si(CH_3)_2$—, e.g., octamethylcyclotetrasiloxane=D 4

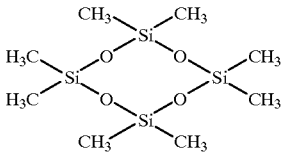

(m) polysiloxanes or silicone oils of the type

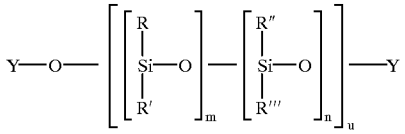

m=0, 1,2,3. . .∞
n=0, 1,2,3. . .∞
u=0, 1,2,3. . .∞
Y=$CH_3$, H, $C_nH_{2n+1}$ n=1–20
Y=$Si(CH_3)_3$,$Si(CH_3)_2H$
$Si(CH_3)_2OH$, $Si(CH_3)_2(OCH_3)$
$Si(CH_3)_2(CnH_{2n+1})$n=1–20
R=alkyl such as $C_nH_{2n+1}$ in which n=1 to 20, aryl such as phenyl- and substituted phenyl groups $(CH_2)$n—$NH_2$, H
R'=alkyl such as $C_nH_{2n+1}$ in which n=1 to 20, aryl such as phenyl- and substituted phenyl groups $(CH_2)$n—$NH_2$, H
R"=alkyl such as $C_nH_{2n+1}$ in which n=1 to 20, aryl such as phenyl- and substituted phenyl groups $(CH_2)$n—$NH_2$, H
R'"=alkyl such as $C_nH_{2n+1}$ in which n=1 to 20, aryl such as phenyl- and substituted phenyl groups $(CH_2)$n—$NH_2$, H The pyrogenically produced alumina-silica mixed oxide is placed in a suitable mixing container. The mixed oxides are sprayed under intensive mixing optionally with water at first and then with the surface-modifying reagent or a mixture of several surface-modifying reagents. The material is mixed again for 15 to 30 minutes and subsequently tempered at a temperature of 100 to 400° C. for a period of 1 to 6 hours.

The water used can be acidified with an acid, e.g., hydrochloric acid, having a pH of 7 to 1. The surface-modifying reagent used can be dissolved in a suitable solvent such as, e.g., ethanol. The mixing and/or tempering can be carried out in an atmosphere of a protective gas such as, for example, nitrogen.

As a result of the incorporation of the pyrogenically synthesized, mixed alumina-silica oxide material of the invention, or the oxide material which is surface modified as mentioned above, into a toner formulation and/or toner formulation mixtures, the toner product of the invention has the following advantages:

(i) Better flowability of the toner powder;

(ii) More stable charging behavior of the toner as characterized by faster chargeability, a higher charge capacity and permitting constant charging over time.

Having now generally described this invention, a further understanding can be obtained by reference to certain specific examples which are provided herein for purposes of illustration only and are not intended to be limiting unless otherwise specified.

EXAMPLES

Example 1

A $Al_2O_3/SiO_2$ mixed oxide is synthesized as follows:

In accordance with the burner arrangement described in Example 1 of U.S. Pat. No. 5,424,258, 1.4 $m^3/h$ (NTP) of nascent hydrogen, or hydrogen of reaction, is mixed together with 5.5 $m^3/h$ (NTP) of air and 1.30 kg/h of previously evaporated $SiCl_4$. Into this mixture, which has a temperature of about 200° C., there is additionally injected 2.34 kg/h of gaseous $AlCl_3$, which had been evaporated beforehand at about 300° C. The resulting mixture is burned in a flame tube, into which 12 $m^3/h$ (NTP) of air is additionally injected.

After passing through the flame tube, the resulting powder is separated in a filter or cyclone from the gases, which contain hydrochloric acid. The adhering residues of hydrochloric acid are separated from the collected mixed oxide by treatment at elevated temperature.

The mixed oxide is characterized by the following analytical data:

Specific BET surface 74 $m^2/g$, a 4% dispersion in water having a pH of 4.49, an apparent density of 46 g/l, a tamped density of 56 g/l. The composition of the powder is 65 wt. % $Al_2O_3$ and 35 wt. % $SiO_2$.

Example 2

The surface of a mixed alumina-silica oxide,is modified as described in European Patent Application A 0 722 992:

A 600 g amount of a mixed alumina-silica oxide material is placed in a plow-type mixer and, while being mixed, is sprayed first with 30 g of distilled $H_2O$ and then with 90 g of HMDS (hexamethyldisilazane). Thereafter mixing is continued for a further 15 minutes and finally the reaction mixture is dried for 3 hours at 140° C. in a drying cabinet.

The physicochemical data of the product are as follows:

| | Experiment 1 | Experiment 2 |
|---|---|---|
| Tamped density [g/l] | 96 | 88 |
| pH | 7.4 | 7.8 |
| C content [% $m^2/g$] | 0.7 | 0.9 |
| Surface [$m^2/g$ | 62 | 65 |
| Drying loss [%] | 0.7 | 0.3 |
| Ignition loss [%] | 1.4 | 2.1 |

Example 3

A 1.8 kg amount of the $Al_2O_3/SiO_2$ mixed oxide described above is placed in a mixer and, while being mixed, is sprayed with 0.27 kg of silicone oil. Thereafter, the surface treated mixed alumina-silica oxide is mixed for an additional 15 minutes and finally subjected to a heat treatment at 300° C. for 2 hours under $N_2$ atmosphere (fluidized bed).

| Physicochemical data: | |
|---|---|
| Tamped density Lg/11 | 106 |
| BET surface [$m^2/g$]: | 57 |
| pH: | 4.2 |
| C content [%]: | 1.3 |

-continued

| Physicochemical data: | |
|---|---|
| Drying loss [%]: | 0.2 |
| Ignition loss [%]: | 1.6 |

The disclosure of German priority Application No. 198 57 912.8 filed Dec. 16, 1998 is hereby incorporated by reference into the present application.

Obviously, numerous modifications and variations of the present invention are possible in light of the above teachings. It is, therefore, to be understood that within the scope of the appended claims, the invention may be practiced otherwise than as specifically described herein.

What is claimed as new and is intended to be secured by Letters Patent is:

1. A toner or a mixture of toners, comprising:

a pyrogenically synthesized alumina-silica mixed oxide as a component in combination with other components necessary to complete a toner formulation;

wherein the amount of the pyrogenically synthesized alumina-silica mixed oxide incorporated into the toner ranges from 0.1 to 5.0% by weight based on the weight of toner.

2. The toner or toner mixture according to claim 1, wherein the pyrogenically synthesized alumina-silica mixed oxide is surface-modified using a surface-modifying agent.

3. The toner or toner mixture according to claim 2, wherein the surface-modifying agent is an organosilane, a halogenorganosilane, a silazane, a polysiloxane or a silicone oil.

4. The toner or toner mixture according to claim 3, wherein the surface of the mixed alumina-silica is modified by treatment with hexamethyldisilazane.

5. The toner or toner mixture according to claim 3, wherein the surface of the mixed alumina-silica is modified by treatment with silicone oil.

6. The toner or toner mixture according to claim 3, wherein the surface of the mixed alumina-silica is modified by treatment with octamethylcyclotetrasiloxane.

7. A method of preparing a toner or a toner mixture, comprising:

mixing a pyrogenically synthesized alumina-silica mixed oxide with the other components necessary to complete a toner composition;

wherein the amount of the pyrogenically synthesized alumina-silica mixed oxide incorporated into the toner ranges from 0.1 to 5.0% by weight based on the weight of toner.

8. The method according to claim 7, wherein the pyrogenically synthesized alumina-silica mixed oxide is surface treated.

9. A toner or a mixture of toners, comprising:

a pyrogenically synthesized alumina-silica mixed oxide obtained by a method comprising:

mixing nascent hydrogen with air and $SiCl_4$ gas;

adding gaseous $AlCl_3$, thereby obtaining a gas mixture;

burning said gas mixture in a flame tube into which additional air has been injected, thereby obtaining a powder;

separating said powder from said gas mixture;

heating said powder, thereby reducing an amount of adhered HCl.

10. The toner or a mixture of toners of claim 9, wherein the pyrogenically synthesized alumina-silica mixed oxide is surface treated.

11. A method of preparing a toner or a toner mixture, comprising:

mixing a pyrogenically synthesized alumina-silica mixed oxide with other components necessary to complete a toner composition;

wherein said pyrogenically synthesized alumina-silica mixed oxide is obtained by a method comprising mixing nascent hydrogen with air and $SiCl_4$ gas; adding gaseous $AlCl_3$, thereby obtaining a gas mixture; burning said gas mixture in a flame tube into which additional air has been injected, thereby obtaining a powder; separating said powder from said gas mixture;

heating said powder, thereby reducing an amount of adhered HCl.

12. The method according to claim 11, wherein the pyrogenically synthesized alumina-silica mixed oxide is surface treated.

* * * * *